US006249112B1

(12) United States Patent
Khouri et al.

(10) Patent No.: US 6,249,112 B1
(45) Date of Patent: Jun. 19, 2001

(54) VOLTAGE REGULATING CIRCUIT FOR A CAPACITIVE LOAD

(75) Inventors: Osama Khouri, Milan; Rino Micheloni, Turate; Ilaria Motta, Cassolnuovo; Guido Torelli, Sant'Alessio con Vialone, all of (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 0 days.

(21) Appl. No.: 09/608,445

(22) Filed: Jun. 29, 2000

(30) Foreign Application Priority Data

Jun. 30, 1999 (EP) ..... 99830418

(51) Int. Cl.[7] ..... G05F 1/40; G05F 1/56
(52) U.S. Cl. ..... 323/282; 323/273
(58) Field of Search ..... 323/268, 270, 323/271, 273–277, 282, 285

(56) References Cited

U.S. PATENT DOCUMENTS 5,548,205 * 8/1996 Monticelli ..... 323/274
5,686,821 * 11/1997 Rokaw ..... 323/273
5,706,240 * 1/1998 Fiocchi et al. ..... 365/226
5,955,915 9/1999 Edwards ..... 327/541
6,157,180 * 12/2000 Kuo ..... 323/282

FOREIGN PATENT DOCUMENTS 0 448 065 A1 9/1991 (EP) .
0 536 693 A2 4/1993 (EP) .

* cited by examiner

*Primary Examiner*—Matthew Nguyen
(74) *Attorney, Agent, or Firm*—Theodore E. Galanthay; Robert Iannucci; Seed IP Law Group, PLLC

(57) ABSTRACT

Presented is a voltage regulating circuit for a capacitive load, which is connected between first and second terminals of a supply voltage generator. The regulating circuit has an input terminal and an output terminal, and includes an operational amplifier having an inverting input terminal connected to the input terminal of the regulating circuit and a non-inverting input terminal connected to an intermediate node of a voltage divider. The voltage divider is connected between an output node, which is connected to the output terminal of the regulating circuit, and the second terminal of the supply voltage generator. The operational amplifier has an output terminal connected, for driving a first field-effect transistor, between the output node and the first terminal of the supply voltage generator. The output terminal of the operational amplifier is also connected to the output node through a compensation network. The voltage regulating circuit also includes a second field-effect transistor connected between the output node and the second terminal of the supply voltage generator, which has its gate terminal connected to a constant voltage generating circuit means.

20 Claims, 2 Drawing Sheets

VOLTAGE REGULATING CIRCUIT FOR A CAPACITIVE LOAD

TECHNICAL FIELD

This invention involves semiconductor storage devices, and relates in particular to a voltage regulating circuit for an essentially capacitive load. A circuit such as this is used to output a precisely controlled voltage and exhibit fast re-establishment capability, even when a previously discharged capacitor $C_s$ is connected to its output. The fast re-establishment ensures that the circuit can restore the output voltage promptly to its regulator-set value.

BACKGROUND OF THE INVENTION

A typical example of circuits in the field of the invention is that of a voltage regulator for reading word lines from multi-level non-volatile memories, where a precisely regulated voltage is vital to optimal reading conditions.

FIG. 1 of the drawings shows a word-line read circuit 10 in a storage device. Upon connection of a capacitor $C_s$ 12, to an output OUT of a regulator 20, a regulator output voltage $V_{reg}$, which has a normal rating value of $V_R$, falls by reason of the charge sharing effect that occurs between the total capacitive load $C_r$ 14, connected to the regulator output and the capacitor $C_s$ 12. In FIG. 1, the circuit connection is represented by a switch SW 16, which is closed when $C_r$ 14 is to be connected to the regulator output OUT.

This fall in the regulator output voltage $V_{reg}$ occurs very rapidly and may be excessive in the sense that it may bring the value of the voltage $V_{reg}$ outside its set range. The return to the voltage $V_{reg}$ should be sufficiently fast, i.e., the regulator output voltage must be quickly brought back into its set range.

Typical values for a storage device parameters may be:

$V_R$=6V $C_r$=100 pF $C_s$=3 pF $\Delta V_{max}$=50 mV, where, $\Delta V_{max}$ is the maximum admitted deviation of $V_{reg}$ from its rating value $V_R$. In other words, the voltage $V_{reg}$ is judged to have been re-established, following connection to the capacitor $C_s$, once the voltage is brought back to within 50 mV of the rating value of $V_{reg}$, and subsequently held within 50 mV of that value.

The appearance of a high capacitive load value delays the regulator 20 operation in that it slows down the re-establishment of the output voltage $V_{reg}$ on the occurrence of charge sharing due to the previously discharged capacitor $C_s$ 12 having been connected to the voltage regulator output OUT. The amount of charge drawn by the capacitor $C_s$ 12 upon connection is:

$$Q_s = (V_{reg} - \Delta V_{\max}) * C_s$$
$$= 5.95 \times 3\ pC$$
$$= 17.85\ pC.$$

Suppose that the re-establishment time is not to exceed 20 ns, then the current that the regulator 20 is to deliver for peak efficiency would be (17.85 pC)/(20 ns) 892.5 $\mu$A, assuming for simplicity that the process of re-establishing the output voltage is taking place at a constant current. Actually, this is not exactly the case, and the overall capacitive load would be charged with a decreasing current over time, so that the peak current supplied by the regulator 20 is bound to exceed the above value.

A prior solution provided a regulator for storage devices which was basically in the form of an operational amplifier 40 connected in a negative feedback loop.

This loop comprised, as shown in FIG. 2, a first stage consisting of a differential amplifier 42, and a second stage consisting of a pull-up element 44 formed of a PMOS transistor and a pull-down element or resistor divider 46 formed of two resistors $R_1$ 48, and $R_2$ 52. The combined stages form the operational amplifier 40. The inverting terminal of the differential amplifier 42 is applied a precise constant voltage, designated $V_{BG}$ in FIG. 2. A junction node 50 between the resistors $R_1$ 48 and $R_2$ 52 is connected to a non-inverting input of the differential amplifier 42, thereby closing the negative feedback loop. In order to provide the loop with adequate stability, a compensation network 54, represented by a block COMP in FIG. 2, may consist of a capacitor connected between the gate and the drain of the pull-up PMOS transistor 44 in the second stage. Other compensation networks may be used, however, such as that discussed by D. B. Ribner and M. A. Copeland in an article "Design Techniques for Cascoded CMOS Op Amps with Improved PSRR and Common-mode Input Range", IEEE Journal of Solid-State Circuits, vol. SC-19, No. 6, December 1984, pages 919–925.

If the loop gain of the feedback loop is sufficiently high, barring such inaccuracies as offset voltages, then the regulator output voltage $V_R$ in the steady-state condition is given as $V_R=V_{BG}*(1+R_1/R_2)$. In an integrated circuit, the resistance ratio between two resistors can be provided with great precision, but for less-than-ideal effects, and the accuracy in value of $V_R$ will depend essentially on the accuracy achieved for the voltage $V_{BG}$. The latter accuracy can be obtained by means of a band-gap type of voltage reference generator, which is known to generate a fairly precise and stable voltage even with such varying factors as the supply voltage and temperature.

Upon connection of the capacitor $C_s$ 12 to the regulator 40 output, the charge originally stored into the capacitor $C_r$ 14 becomes shared with the capacitor $C_s$. The regulator output voltage at the end of the charge sharing process is, assuming inaction of the control loop at this stage:

$$V_{reg}=C_sV_R/(C_s+C_r) \quad (1)$$

Therefore, the theoretical voltage drop at the regulator output can be written as:

$$\Delta V_{reg}=V_r/(1+C_r/C_s)=V_RC_s/C_r \quad (2)$$

Substituting the values given above, we get $\Delta V_r$=180 mV, which exceeds the maximum error value admitted on line $V_{reg}$($\Delta V_{max}$=50 mV). Thus, the regulator 40 is to supply the required electric charge for re-establishing the voltage to its desired value.

With very high total capacitive loads (e.g., 100 pF) on the regulator 40 output, the voltage $V_{reg}$ may not be re-established as quickly as desired, because the product of band by gain is limited in the amplifying structure.

Prior approaches to solving this problem presupposed that the capacitance of $C_s$ 12, and the time when its connection to the regulator output node OUT is required, were known beforehand. In addition, such approaches involved of necessity the generation of appropriate clock drive signals.

However, such prior solutions cannot be used where the capacitance of $C_s$ 12 or the time when $C_s$ is connected to the regulator output node OUT is not exactly known beforehand (as is the case when the problem is unrelated to the drive of word lines in a non-volatile memory).

Until now, no circuit solution was available that provides for fast re-establishment of the voltage $V_{reg}$ upon a previously discharged capacitor being connected to the output terminal of the regulator, through the use of a circuit that is easy to implement, and not the prior capacitive compensation or capacitive boost techniques.

SUMMARY OF THE INVENTION

Embodiments of the invention include a voltage regulating circuit for a capacitive load, which is connected between a supply and a ground terminal of a supply voltage generator. The regulating circuit has an input terminal and an output terminal, and includes an operational amplifier having an inverting input terminal connected to the input terminal of the regulating circuit and a non-inverting input terminal connected to an intermediate node of a voltage divider. The voltage divider is connected between an output node, which is connected to the output terminal of the regulating circuit, and the second terminal of the supply voltage generator. The operational amplifier has an output terminal connected, for driving a first field-effect transistor, between the output node and supply terminal of the supply voltage generator. The output terminal of the operational amplifier is also connected to the output node through a compensation network. The voltage regulating advantageously includes a second field-effect transistor connected between the output node and the ground terminal of the supply voltage generator, which has its gate terminal connected to a constant voltage generating circuit.

In another embodiment, a third field effect transistor is coupled between the output node and the supply node of the supply voltage generator, which is driven by another constant voltage generating circuit.

The features and advantages of a voltage regulating circuit according to the invention will become apparent from the following description of an embodiment thereof, given by way of example and not of limitation with reference to the accompanying drawings.

It is generally noted that the description of the embodiments explained below includes language of especially preferred embodiments, such as transistors built to match other transistors and currents equaling one another. Strictly speaking, these features are not necessary to practice the invention, but are anyway disclosed to enable the reader to more fully understand the usefulness of the invention.

DETAILED DESCRIPTION OF THE INVENTION

Figure 2:
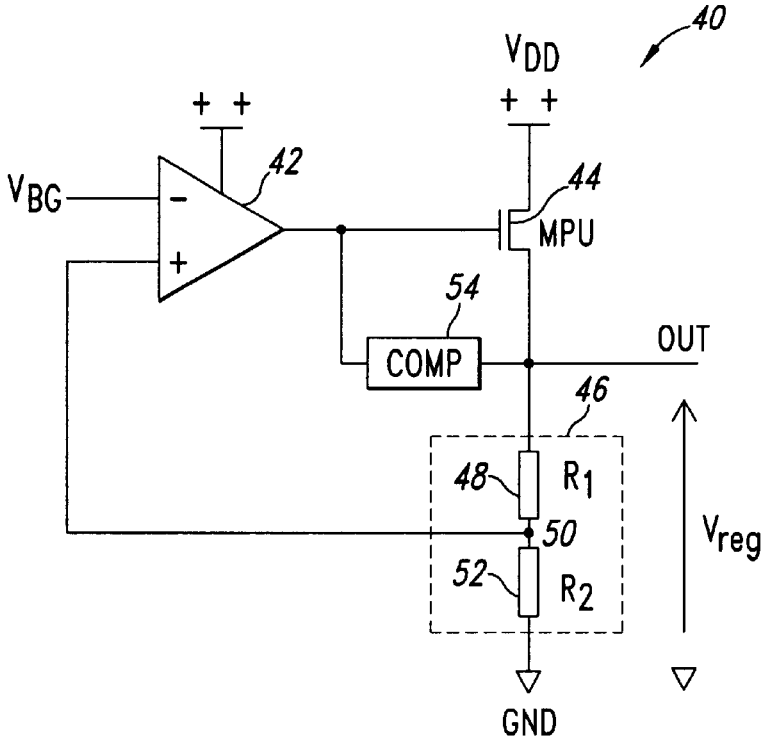
Fig. 2 (Prior Art)
FIG. 2 shows a voltage regulating circuit for a capacitive load, according to the prior art.

A basic task of the feedback loop of the circuit shown in FIG. 2 is to prevent the occurrence of ringing, as apt to result in overshooting of the voltage $V_{reg}$, during the transient associated with a capacitor $C_s$ 12 being connected to the output terminal of the regulator. The output node OUT of the regulator 40 has an instantaneous voltage $V_{reg}$, and a desired regulated voltage of $V_R$. In ideal conditions, $V_{reg}$, will always equal $V_R$, but due to the conditions mentioned above, they may differ. If the voltage $V_{reg}$ rises above its rating value $V_R$, its fall toward $V_R$ must go through resistors $R_1$ 48 and $R_2$ 52. This fall will be quite slow, due to the high capacitance of $C_r$ 14 unless sufficiently low resistances are selected for $R_1$ 48 and $R_2$ 52. However, low resistances of $R_1$ 48, $R_2$ 52 result in high DC power consumption of the regulator, which may be unacceptable in some cases. For example, a high power consumption may be unacceptable where a voltage regulator is connected in an integrated circuit which is supplied a lower single external supply voltage $V_{DD}$ than the regulator own supply voltage; it being possible to drive the latter from $V_{DD}$ using a voltage boosting circuit based on the charge pump technique that usually exhibits limited capacity for current output.

In the past, the need to prevent this behavior had prompted previous designers to design an amplifier with a very large phase margin, thus reducing the band and with it the rate of operation of the amplifier. In fact, lacking such a large phase margin, the risk of ringing and overshooting of the output voltage may be incurred as the closed loop system responds to the fall in voltage caused by connecting $C_s$ 12.

Figure 3:
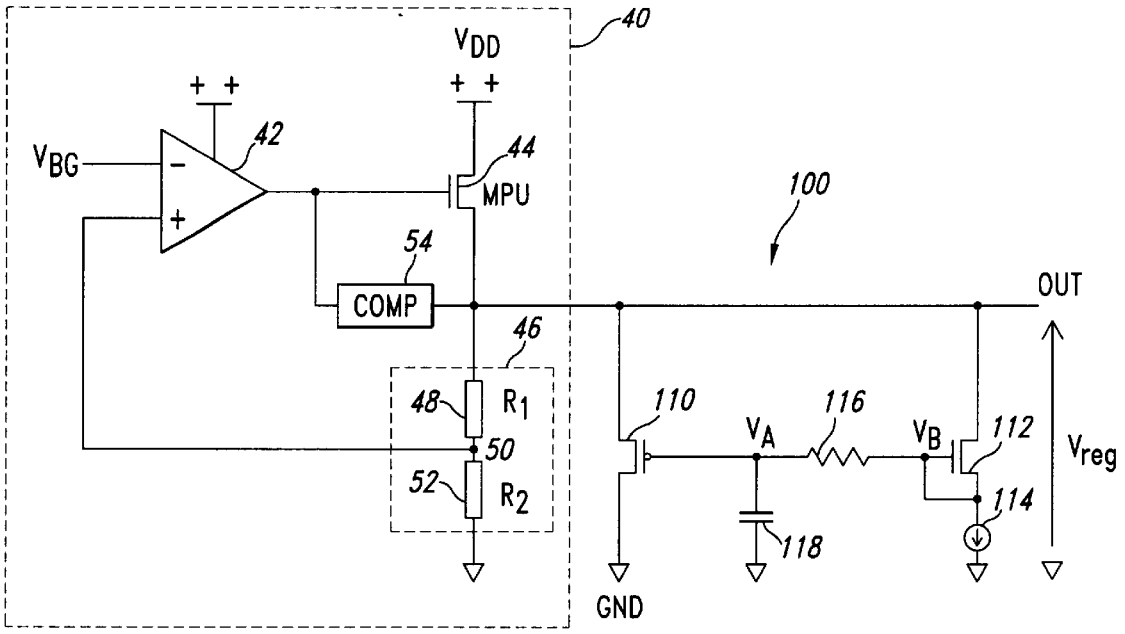
FIGS. 3 and 4 show two embodiments of a voltage regulating circuit for a capacitive load, according to this invention.

To obviate such problems, an embodiment of the invention provides for a circuit structure 100 coupled to the regulator 40 of FIG. 2. In this circuit 100, a pull down PMOS transistor 110 is used, as shown in FIG. 3. A source of the transistor 110 is coupled to an output node OUT of a voltage regulator 40, and its drain is connected to ground. Its gate electrode is driven with a constant voltage $V_A$ of a suitable value. The aspect ratio W/L of the transistor 110 and the value of the voltage $V_A$ should be selected to keep the transistor 110 saturated and produce a small DC (or bias current) flow through the transistor 110, so as to limit the power consumption of the structure at rest. It is for this reason that the value $V_{GS}-V_{THP}$, where $V_{GS}$ is the transistor gate-source voltage and $V_{THP}$ is the transistor threshold voltage of the PMOS transistor 110, is kept suitably low.

As a preliminary approach, a current $I_D$ flowing through a saturated PMOS transistor is known to depend quadratically on the voltage $V_{GS}-V_{THP}$ when the transistor is operated in a region of strong inversion, that is, when the difference $V_{GS}-V_{THP}$ is negative and sufficiently high in absolute value, and is tied exponentially to $V_{GS}$ as the difference $V_{GS}-V_{THP}$ approaches zero. At all events, $I_D$ increases as the voltage $V_{SG}=-V_{GS}$, that is the difference between the source voltage and the gate voltage, increases. When the voltage at the output node of the regulator exhibits overshooting, the current flowing through the transistor 110 can become considerably larger than the current which flows through the same transistor in the rest condition (i.e., when $V_{reg}=V_R$); the voltage $V_{SG}$ at the transistor MPD is, in fact, equal to $V_{reg}-V_A$, and its value increases for positive overshoots of $V_{reg}$.

While the power consumption is relatively low in the rest condition, with positive overshoots raising the voltage $V_{reg}$ to a value higher than $V_R$, the output node OUT discharge current becomes large and the value of $V_{reg}$ falls very fast. Accordingly, the operational amplifier of the regulating loop can be dimensioned to have a lower phase margin, and therefore a wider band, than if no transistor 110 were provided. Thus, by providing the transistor 110, the operational amplifier can be dimensioned to accommodate overshoots in the regulating loop output voltage. On the occurrence of such overshooting, the voltage can be quickly brought back to within the admitted range of values.

FIG. 3 also shows a simple circuit for generating the voltage $V_A$. It includes a PMOS transistor 112 and a current generator 114 generating a current $I_B$. Conventionally, the current generator 114 can be simply formed of an NMOS transistor driven with a constant voltage of a suitable level; for example, it could be the output section of a current mirror, the input section whereof is supplied a constant current of known value. The two transistors 110, 112 match each other, i.e., are identical with each other (at least nominally) but for an appropriate scaling factor K of the channel width W. In the rest condition, both transistors 110, 112 have the same gate-source voltage $V_{GS}$; they have the same source voltage because their respective sources are short-circuited, and have the same gate voltage because no current passes through a resistor 114 having a resistance $R_b$. Both transistors 110, 112 also have the same threshold voltage $V_{THP}$ (but for some minor differences arising from the manufacturing process being less than ideal). Accordingly, the direct current flowing through the transistor 110 will be essentially equal to $K \cdot I_B$. By an appropriate choice of the values of $I_B$ and K, the bias current to the transistor 110 can be held sufficiently low and the power consumption of the structure at rest be reduced. Mismatching of the two transistors 110, 112 due to practical effects might indeed cause the current to become different from $K \cdot I_B$, but such differences can be minimized by appropriate component designing.

The resistance $R_B$ of the resistor 116 multiplied by a capacitance $C_B$ of a capacitor 118 forms a low-pass filter. In DC, the voltage $V_A$ is the same as the voltage $V_B$, and any quick changes in the voltage $V_B$ (as caused by quick changing of the voltage $V_{reg}$, for example) do not propagate to the voltage $V_A$ because of the filtering action applied by the $R_BC_B$ combination of the resistor 116 and the capacitor 118. Of course, both components 116, 118 would have to be suitably dimensioned, this being a simple matter for circuit designers. For example, to adequately "filter out" voltage variations at a characteristic time of less than 10 ns, $R_B$=5'kΩ and $C_B$=1 pF could be chosen. Other filter structures of the low-pass type may be used to make the voltage $V_B$ virtually constant.

When the voltage $V_{reg}$ drops rapidly below the regulated value of $V_R$, the transistor 110, having the voltage $V_{reg}-V_{th}+V_{ov}$ applied to its gate, will tend to turn off and promote re-establishment to the regulated voltage, where $V_{th}$ is the threshold voltage of the transistor 110 and where $V_{ov}$ is the overvoltage of transistor 110.

An advantage of the circuit shown in FIG. 3 lies in its great simplicity: in fact, above the required components already present for the voltage regulator 40, only two additional transistors 110 and 112 are required, plus the resistor 116 and the capacitor 118. For proper operation, no switches are needed as would require associated drive signals. The current draw at rest of the additional structure, i.e., the current through the transistors 110, 112, can be kept fairly low, and the discharge current from the output node OUT of the voltage regulator 40, as the voltage $V_{reg}$ at the output node OUT undergoes sharp rises due to overshooting, can be much larger than the current flowing through transistor 110 at rest. As said before, this enables the operational amplifier 42 in the regulating loop to be designed with a moderate phase margin, and hence, with a higher band (and higher rate), than without the additional structure.

A further advantage of a circuit according to embodiments of the invention is as explained herein below. In the rest condition, the current flowing through the transistor 44 is equal to the sum of the currents flowing through the resistive divider 46 and the transistors 110, 112. By a suitably scaling factor K, the current through the transistor 112 can be made trivial, so that the combined currents become substantially equal to the sum of the currents through the resistor divider 46 and the transistor 110.

Should the voltage $V_{reg}$ from the output node OUT of the voltage regulator 40 fall in operation rapidly below the regulated value $V_R$ (in consequence of a previously discharged capacitor being connected to the regulator output OUT, for example), then the transistor 110 would draw less current than at rest. This difference becomes greater as the voltage $V_{reg}$ drops further. Its dependence on the value of the voltage drop is as previously explained; this drop may be great enough to cause the transistor 110 to be blocked. On this account, for a given current at rest, the pull-up transistor 44 is now able to deliver a larger current to the external capacitive load than would be possible if the transistor 110 were not there. This contributes to making the re-establishment of the output current faster, for a given current at rest and, therefore, a given power consumption.

Mathematically, the relationship that leads to a transistor being turned off can be described as follows: with $V_{ov}$ being the overdrive voltage to the transistor 110 at rest, the voltage $V_A$ will be $V_R-|V_{THP}|-|V_{ov}|$. Upon the voltage $V_{reg}$ falling rapidly below the regulated value by an amount $|V_{ov}|$, the transistor 110 tends to turn off, thereby promoting re-establishment to the regulated voltage.

It should be noted, however, that the transistor 112 serves no clamping function, since the output voltage of the voltage regulator 40 is set by the regulating loop.

Figure 4:
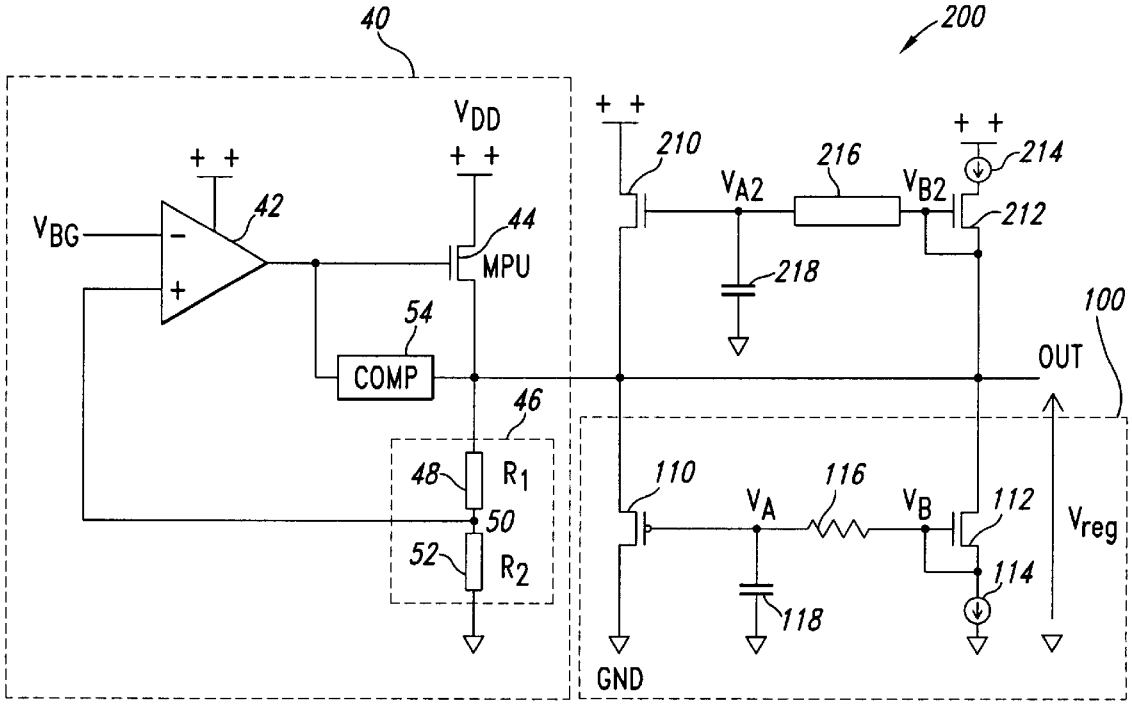

This embodiment can be improved by adding a second circuit structure 200 between the output of the voltage regulator 40 and a positive supply $V_{DD}$, as shown in FIG. 4. The second circuit structure 200 is similar to the circuit structure 100 shown in FIG. 3, but it is made of NMOS transistors, as will be explained below.

The portion affected by the addition shown in FIG. 4 includes an NMOS transistor 212 having its gate shorted to its drain. A gate/drain node $V_{B2}$ is coupled to the positive supply $V_{DD}$ through a fixed current generator 214 that generates the same amount of current as the underlying generator in FIG. 4. The two current generators 114, 214 are matched together. The node $V_{B2}$ is connected to a node $V_{A2}$ via a resistance 216. A capacitor 218 is connected between the node $V_{A2}$ and ground. The node $V_{A2}$ is connected to the gate of an NMOS transistor 210 having a drain connected to the positive supply $V_{DD}$ and a source connected to the regulator output node OUT. The transistor 210 has a W/L ratio which is K times larger than that of 212, where K is also the scaling factor between the aspect ratio of transistors 110 and 112 of the circuit structure 100. This means that the W/L of the transistor 110 is K times larger than the W/L of 112, as previously explained. Preferably, a cut-off frequency introduced by a resistance $R_{B2}$ of the resistor 216 multiplied by a capacitance $C_{B2}$ of the capacitor 218 is the same as that introduced by the combination of the resistance 116 and the capacitor 118 of the circuit 100. Both combinations are low-pass filters; however, no difference is made should their cut-off frequencies be different, provided that they are sufficiently low, that is low compared to the variation frequency of $V_{reg}$; the most straightforward course is at any rate that of making the two cut-off frequencies equal each other.

A regulating loop, which includes the differential amplifier 42, a leg including the pull-up transistor 44 and the resistive divider 46, the compensation network 54, and the feedback line, sets the DC value of the output voltage $V_{reg}$ at the node OUT. The designer should choose a desired value for $V_{reg}$ by suitable selection of the value of $V_{BG}$ (in this example, equal to the band-gap voltage) and the value of the R1 48 /R2 52 ratio in the resistive divider 46, as previously explained. The values of $V_B$ and $V_{B2}$ will depend on the value of $V_{reg}$ determined by the regulating loop as above.

Specifically, $V_B$ is equal to $V_{reg}-|V_{THP}|-V_{ov}^{P}$, and $V_{B2}$ is equal to $V_{reg}+V_{THN}+V_{ov}^{N}$, where the symbols have the same meaning as before. Thus, the values of $V_B$ and $V_{B2}$ will automatically match the value of $V_{reg}$, which depends on the values of the fabrication process parameters, and "follow" the value of $V_{reg}$ if the latter changes "slowly" due for example to temperature changes, aging of the components, etc. The values of $V_A$ and $V_{A2}$ are respectively identical in DC with those of $V_B$ and $V_{B2}$. The values of $V_A$ and $V_{A2}$ will be substantially identical with those of $V_B$ and $V_{B2}$, respectively, even at a low frequency, that is lower frequencies than the cutoff frequencies of the filter formed by resistor 116 with the capacitor 118 and the filter formed by the resistor 216 with the capacitor 218. The DC current flowing through the transistor 110 will be dependent on the ratio K of the W/L values for the transistors 110 and 112, and, in particular, will be equal to $K*I_B$. Likewise, the current flowing through the pull-up transistor 44 will be dependent on the ratio K and the W/L values for the transistors 210 and 212. The value of K is the same for either structures, so that the current delivered from the transistor 212 will flow through the transistor 110, at least in theory.

In DC, adding the circuit structures 100 and 200 to the voltage regulator 40 bears essentially no influence on the voltage $V_{reg}$. In fact, the low output impedance of the feedback loop sets the value of $V_{reg}$; this, in turn, sets the DC values of the voltages $V_A$ and $V_{A2}$ which, as mentioned before, will "follow" the DC value of $V_{reg}$.

Any reference to DC values infers reference to possible "slow" variations of these values over time, for example as due to changes in temperature, aging of components, etc. The bias of the transistors 210 and 110 will "match" the value of $V_{reg}$ to cause the current through them to be the desired current, namely $K*I_B$, but without substantially affecting the value of $V_{reg}$.

Figure 1:
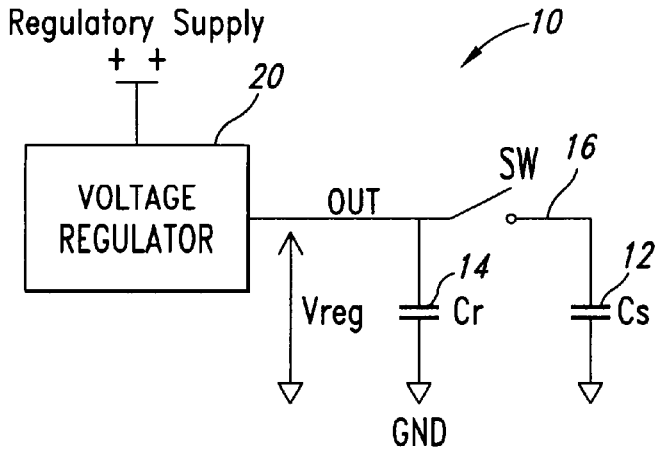
Fig. 1 (Prior Art)
FIG. 1 is a schematic diagram of a regulator for regulating the read voltage in multi-level non-volatile memories according to the prior art.

At higher frequencies than the cutoff frequency of the RC combinations, the nodes $V_A$ and $V_{A2}$ do not follow the variations of $V_{reg}$. If $V_{reg}$ varies upwards of the regulated value, the transistor 210 would tend to turn off, and the transistor 110 to conduct more. This causes a current draw to come in through the terminal $V_{reg}$ and discharge the total capacitance linked to the node OUT (in FIG. 1, $C_r$ 14+$C_s$ 12), so that the voltage $V_{reg}$ falls and is quickly restored to the desired value. Upon this value being attained, the current flowing through the transistor 210 will be same as that through the transistor 110, and accordingly, the incoming current through the terminal OUT be cancelled. Moreover, the current through the pull-up transistor 44 also equals that through the resistive divider 46, and a balanced condition is therefore achieved. On the other hand, if $V_{reg}$ varies downwards of the regulated value, the transistor 210 would tend to conduct more and the transistor 110 tends to turn off. This causes a current to be output through the output terminal OUT and charge the total capacitance linked to the node OUT (in FIG. 1, $C_r$ 14+$C_s$ 12), so that the voltage $V_{reg}$ quickly rises back to the desired value.

The operation of the complementary circuit structure 200 is similar to that of the circuit structure 100, except, of course, that the voltage and current polarities are now changed.

By providing the additional circuit structures 100 and 200, the voltage $V_{reg}$ at the output node OUT can be quickly restored to its set value, even in the presence of fast "noise" at the output. The operation does not go through the regulating loop, and can therefore be very fast, provided that the components are suitably dimensioned. Conventional techniques are based instead on operation of the regulating loop, which has its rate inherently limited by the need for a stable frequency. This represents a major advantage of the additional combined circuit structures 100 and 200.

Furthermore, these circuit structures 100 and 200 can accommodate any overshooting of the regulating loop response, so that the loop can be designed for a moderate phase margin, and exhibit a wider band and improved frequency response.

The bias of the nodes $V_A$ and $V_{A2}$ "follows" the $V_{reg}$ at the output node OUT, and is therefore dependent on the latter. The impedance of the two transistors 110, 210 to the node OUT is high at rest. The circuit structures 100, 200 operate quickly in the presence of small voltage deviations at $V_{reg}$ from the regulated value. This is because of the biasing for the transistors 210 and 110, i.e., due to "self-matching" of the bias voltages of their respective gate electrodes. Additionally, to save on power consumption, $I_B$ can be kept small.

It is understood that transistors arranged to operate basically as switches could be introduced for zeroing the power consumption in those situations where power consumption is desired to be substantially nil. For example, a switch could be connected between the drain of the transistor 210 and the positive supply, and a switch connected between the drain of the transistor 110 and ground. Likewise, switches may be connected in the legs that generate the voltages $V_B$ and $V_{B2}$. Also, the capacitors 118, 218 could be connected to the supply $V_{DD}$ rather than to ground.

Changes can be made to the invention in light of the above detailed description. In general, in the following claims, the terms used should not be construed to limit the invention to the specific embodiments disclosed in the specification and the claims, but should be construed to include all methods and devices that are in accordance with the claims. Accordingly, the invention is not limited by the disclosure, but instead its scope is to be determined by the following claims.

What is claimed is:

1. A voltage regulating circuit for essentially capacitive loads, being connected between first and second terminals of a supply voltage generator and having an input terminal and an output terminal, the regulating circuit comprising:

an operational amplifier having an inverting input terminal connected to the input terminal of the regulating circuit and a non-inverting input terminal connected to an intermediate node of a voltage divider which is in turn connected between an output node coupled to the output terminal of the regulating circuit and the second terminal of the supply voltage generator, and the operational amplifier having an output terminal coupled between the output node and the first terminal of the supply voltage generator for driving a first field-effect transistor, said output terminal of the operational amplifier being further coupled to the output node through a compensation network;

a second field effect transistor coupled between the output node and the second terminal of the supply voltage generator, the second field effect transistor having a control terminal coupled to one of the terminals of the supply voltage generator via a first capacitive element and coupled, via a first resistive element, to a control terminal of a third field-effect transistor which is diode connected between the output node and the second terminal of the supply voltage generator; and a first constant current generator being connected in series between the third field-effect transistor and said second terminal of the supply voltage generator.

2. The voltage regulating circuit according to claim 1, further comprising:

a fourth field effect transistor coupled between the output node and the first terminal of the supply voltage generator, the fourth field effect transistor having a control terminal connected, via a second capacitive element, to one of the terminals of the supply voltage generator and also connected, via a second resistive element, to a control terminal of a fifth field-effect transistor which is diode connected between the first terminal of the supply voltage generator and the output node; and a second constant current generator being coupled in series between the fifth field-effect transistor and the first terminal of the supply voltage generator.

3. The voltage regulating circuit according to claim 1 wherein the first, second and third field-effect transistors are PMOS-type transistors whose control terminals are gate terminals, respectively.

4. A voltage regulating circuit according to claim 2 wherein the fourth and fifth field-effect transistors are NMOS-type transistors whose control terminals are gate terminals, respectively.

5. A voltage regulating circuit having an input terminal and an output terminal, comprising:

a differential amplifier having an inverting input coupled to the input terminal and having a non-inverting input and an output;

a regulating loop for the differential amplifier including an output transistor having a control terminal coupled to the output of the differential amplifier, having a first conduction terminal coupled to a supply voltage, and having a second conduction terminal coupled to the output terminal of the voltage regulating circuit, a resistive divider including at least two resistances, the resistor divider coupled between the output terminal of the voltage regulating circuit and a reference voltage, a feedback loop coupled between the non-inverting input of the differential amplifier and one of the at least two resistances in the resistive divider, and a compensation network coupled between the output of the differential amplifier and the output terminal of the voltage regulating circuit; and a pull down transistor coupled outside of the regulating loop, between the output terminal of the voltage regulating circuit and the reference voltage, the pull down transistor having a control terminal coupled to a constant voltage source.

6. The voltage regulating circuit of claim 5, further comprising a pull up transistor coupled outside of the regulating loop, between the output terminal of the voltage regulating circuit and the supply voltage, the pull up transistor having a control terminal coupled to a second constant voltage source.

7. The voltage regulating circuit of claim 6 wherein the pull up transistor and the pull-down transistor are matched transistors.

8. The voltage regulating circuit of claim 6 wherein a voltage of the constant voltage source is approximately equal to a voltage of the second constant voltage source.

9. The voltage regulating circuit of claim 6 wherein the pull down transistor is a PMOS transistor and wherein the pull up transistor is an NMOS transistor.

10. The voltage regulating circuit of claim 5 wherein the constant voltage source comprises:

a diode-coupled transistor coupled to the output terminal of the voltage regulating circuit; and a current generator coupled between the diode-coupled transistor and the reference voltage.

11. The voltage regulating circuit of claim 10, further comprising a low pass filter network coupled between the diode-coupled transistor and the pull down transistor.

12. The voltage regulating circuit of claim 11 wherein the low pass filter network comprises:

a filter resistor coupled between the control terminal of the pull down transistor and a control terminal of the diode-coupled transistor; and a capacitor coupled to the filter resistor.

13. The voltage regulating circuit of claim 12 wherein the capacitor is also coupled to the reference voltage.

14. A method of producing a regulated voltage comprising:

producing a first regulated voltage at a first conduction terminal of an output transistor by using a differential amplifier to compare an input voltage to a voltage that is fed back to the differential amplifier through a feedback network and drive the output transistor based on the comparison of voltages;

coupling a first conduction terminal of a regulating transistor to the first conduction terminal of the output transistor;

coupling a second conduction terminal of the regulating transistor to a voltage reference; and driving a control terminal of the regulating transistor with a voltage held constant with respect to the voltage reference.

15. The method of claim 14, further comprising:

coupling a first conduction terminal of a second regulating transistor to the first conduction terminal of the output transistor;

coupling a second conduction terminal of the second regulating transistor to a second voltage reference; and driving a control terminal of the second regulating transistor with a voltage held constant with respect to the second voltage reference.

16. The method of claim 15 wherein coupling a second conduction terminal of the regulating transistor to a voltage reference comprises coupling the second conduction terminal of the regulating transistor to a ground reference, and wherein coupling a second conduction terminal of the second regulating transistor to a second voltage reference comprises coupling the second conduction terminal of the second regulating transistor to a supply voltage reference.

17. The method of claim 14 wherein driving a control terminal of the regulating transistor with a voltage held constant with respect to the voltage reference comprises:

generating a constant voltage; and coupling a gate terminal of the regulating transistor to the constant voltage.

18. The method of claim 17 wherein generating a constant voltage comprises:

coupling a diode-coupled transistor to the first conduction terminal of the output transistor; and coupling a current generator between the diode-coupled transistor and the voltage reference.

19. The method of claim 17 wherein the gate terminal of the regulating transistor is coupled to the constant voltage through a low-pass filter network.

20. The method of claim 19 wherein the low-pass filter network comprises a filter resistance and a capacitance coupled between the constant voltage and the gate terminal of the regulating transistor.

* * * * *